United States Patent [19]

Wielgos et al.

[11] Patent Number: 4,471,182

[45] Date of Patent: Sep. 11, 1984

[54] SINGLE POLE MAKE MAKE SWITCH AND PRESSURE SWITCH USING SAME

[75] Inventors: Thaddeus S. Wielgos, Des Plaines; Richard L. Lauritsen, Hoffman Estates, both of Ill.

[73] Assignee: The Singer Company, Stamford, Conn.

[21] Appl. No.: 473,889

[22] Filed: Mar. 10, 1983

[51] Int. Cl.[3] ..... H01H 35/34

[52] U.S. Cl. ..... 200/83 P; 200/67 D; 200/67 DA

[58] Field of Search ..... 200/83 R, 83 WM, 83 A, 200/83 B, 83 C, 83 D, 83 F, 83 J, 83 L, 83 N, 83 P, 83 Q, 83 S, 83 SA, 83 T, 83 V, 83 Y, 83 W, 83 Z, 67 D, 67 DA, 1 B; 337/309, 311

[56] References Cited

U.S. PATENT DOCUMENTS 3,529,107 9/1970 Dobrickin ..... 200/83 P 3,578,926 5/1971 Obermann ..... 200/67 D

*Primary Examiner*—Patrick R. Salce

*Assistant Examiner*—Morris Ginsburg

*Attorney, Agent, or Firm*—David L. Davis; Robert E. Smith; Edward L. Bell

[57] ABSTRACT

A pressure switch has a solid piston sealed by a Kapseal and O-ring actuating a spring locator to compress a main spring and then a secondary (optional) spring. The locator actuates a slow moving end of a snap switch blade. The slow moving end has a contact which opens a low voltage circuit and then the snap switch end of the blade is actuated to open another circuit. This attains a single pole make make operation with sequencing assured.

5 Claims, 8 Drawing Figures

SINGLE POLE MAKE MAKE SWITCH AND PRESSURE SWITCH USING SAME

BACKGROUND OF THE INVENTION

There is no prior art known to us relating to a single pole make make switch nor to a pressure switch using such a switch. A potential customer requested a pressure switch for use in conjunction with a brake system to control two electric circuits in a definite sequence. Space limitations militated against two separate switches. Further, an arrangement insuring a certain sequence for separate switches can get complicated and costly. The brake system pressures are high. Conventional pressure switch designs are questionable in this use.

SUMMARY OF THE INVENTION

An object of this invention is to provide a simple switching arrangement which guarantees sequencing two circuits. This is achieved by providing a single pole make make switch having a common input to the switch blade which controls two separate circuits in a manner which guarantees sequencing of the circuits. One of the circuits includes a slow-moving contact and the other circuit includes a snap action contact.

Another object is to provide a pressure switch operating in response to high brake system pressures under vibratory conditions and extreme temperature ranges. The pressure switch has a simple piston acting on a switch actuator through a spring cartridge. The piston is a simple rod sealed by a novel seal arrangement. The spring cartridge employs a pre-loaded spring(s) which can be handled as a sub-assembly. The piston seal is novel in this environment.

The switch itself is an outgrowth of the snap switch in U.S. Pat. No. 3,578,926. That switch can accommodate considerable overtravel. In effect the present switch adds to the actuated end of the '926 blade a contact which engages a low voltage, low current fixed contact. These contacts separate gradually and are provided to control a tell tale warning lamp.

DETAILED DESCRIPTION OF THE DRAWINGS

Figure 1:
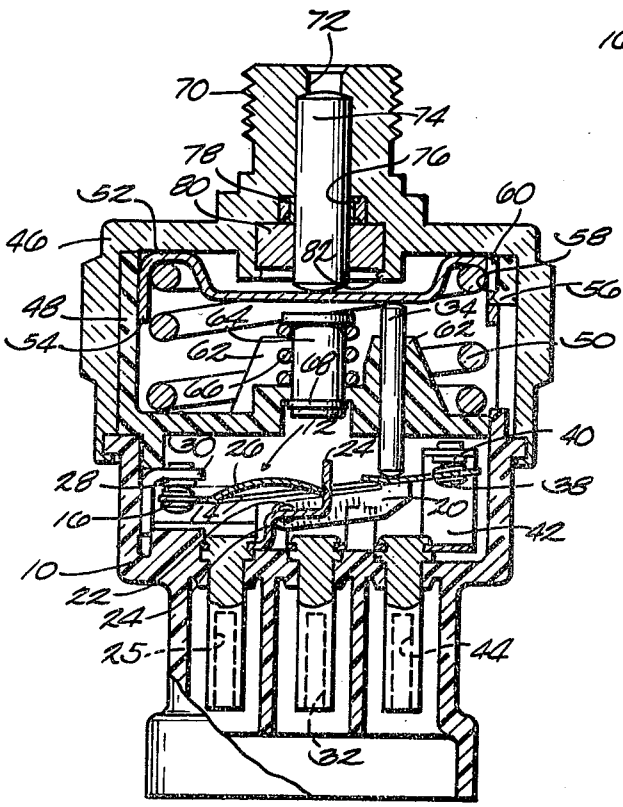
FIG. 1 is a vertical section through a pressure switch which incorporates the novel single pole make make switch. The parts are shown in the at-rest position, i.e., no pressure applied.

The lower plastic housing 10 has the single pole make make switch blade 12 mounted in the central cavity. The switch blade 12 has tensioned side rails 14, 14 interconnected at their end with a contact 16 on the free or snap acting end while the other cross piece or interconnection 18 serves as the actuating point. The blade 12 has formed arms 20 which run generally parallel to and below the plane of the blade 12 to have the holes 22 in the end of each arm mounted on pins which are part of the electrically conductive support 24 which is notched to receive the end of the bowed compression tongue 26 extending from the contact 16 end to the support 24 to place the side rails 14 under tension and the arms 20 under compression. The support 24 is connected to the connection terminal 25. This terminal is connected to negative ground in an automotive electrical system. Typically, the compression tongue 26 will bias the blade 12 to the position shown in FIG. 1 in which the snap acting contact 16 engages the fixed contact 28 mounted on bus 30 which is formed to connect to the terminal 32. This terminal 32 is connected in a relay circuit for operating a hydraulic pump for the purpose of establishing pressure in an automotive brake system, as is known in the art. When the contact 16 engages the contact 28 as shown in FIG. 1, there is a circuit completed from positive through the relay and the contact 16–28 to ground and the pump will be energized.

Actuator 34 bears on actuating point 18. The switch blade 12 as described to this point is very similar to that shown in U.S. Pat. No. 3,578,926. The present blade, however, has an extension 36 at the actuated end. This extension 36 carries a contact 38 which engages fixed contact 40 connected via bus 42 to terminal 44 which is in an indicator lamp circuit. When the actuator 34 moves down, as will be explained more fully hereinafter, contact 38 moves with a slow or creep action and will break engagement with the fixed contact 40 in a slow manner. This is acceptable in a low power circuit such as an indicator lamp circuit. This circuit must, of necessity, break before the actuator has moved the actuating point down far enough to permit the side rails 14 of the blade to pass the plane of the ends of the bowed compression tongue 26 to thereby cause the snap contact 16 to be quickly separated from its fixed contact 28. Thus, the sequencing of these switches is guaranteed.

The upper part of the pressure switch housing is an inverted metal cup-like housing 46 the lower edge or skirt of which is rolled over the flange on the lower housing 10 to lock the two parts together. The interior of the metal housing 46 contains a spring cartridge which is a complete sub-assembly when placed in the pressure switch housing and is, therefore, very easy to handle with no risk that the springs will get out of control during assembly. The spring cartridge includes a plastic spring cup 48 housing spring 50 which is compressed between the bottom of the cup 48 and the underside of the spring locator 52. The locator 52 has an inverted trough receiving the upper end of the spring 50 and has a peripheral skirt 54 which fits inside the cup 48 and guides the spring locator 52 for axial sliding movement inside the cup 48. At three locations around the side wall of the cup 48, the wall is slotted to leave the depending lock finger 56 free to flex. The inside of each lock finger 56 is ramped at 58 to cam the finger aside as the spring locator 52 is pushed down far enough to enable the lock finger 56 to snap back to its normal position in which the downwardly facing squared off face of the finger 56 will engage the upper surface of the locator skirt where it has been cut out at 60. Thus, the finger 56 fits into the cutout 60 to prevent the locator 52 from moving outwardly beyond the illustrated position. The locator 52 is free to be pushed down inside the spring cup 48. Thus, the locator 52 is locked into position, preloading spring 50 and enabling the spring cartridge to be handled as a sub-assembly.

The spring locator 52 can move down into the cup 48 only until it engages the tops of the cones or bosses 62. The spring cartridge is also provided with a central preloaded plunger or rod 64 having an upper flange or shoulder. A secondary spring 66 is compressed between the floor of the cup 48 and the shoulder of the rod 64 to bias the rod 64 upwardly with the upward position being limited by engagement of the "C" ring 68, mounted on the bottom of the rod 64, with the underside of the cup 48. Thus, in the position shown in FIG. 1 the spring locator 52 does not engage the plunger 64. After the locator 52 moves down to engage the rod 64, the spring 66 is compressed. This secondary spring arrangement is very desirable, but obviously costs more than doing without. The present invention uses the secondary spring 66 or it can be omitted, depending on user requirements. If the spring 66 is omitted, many instances will require that the position of the fixed contacts 28, 40 and possibly the central support for the blade 12 be made adjustable to permit fine tuning the actuating points, all as more fully hereinafter described.

The upper end of the metal housing 46 is provided with a threaded inlet 70 having a central opening 72 to permit brake fluid to enter the interior of the inlet. The bore of the inlet is enlarged inside the opening 72 to receive a solid piston 74 which is axially movable inside the inlet. The piston is sealed by a Teflon (tetrafluroethylene) Kapseal 76 which has a generally channel-like cross section in which the O-ring 78 is received. When the O-ring is subjected to pressure it will, as is well known, tend to exert an inward force against the piston. This force acts through the Kapseal 76 which has a low co-efficient to friction and permits the piston 74 to slide back and forth with relatively small resistance while the Teflon aids in reducing leakage along the length of the piston 74 due to the non-wetting characteristic of Teflon. The O-ring and Kapseal sub-assembly is held in place by means of the stainless steel washer 80 which is staked in place by staking the corner 82 at two or three locations. The piston 74 bears against the spring locator 52.

Figure 3:
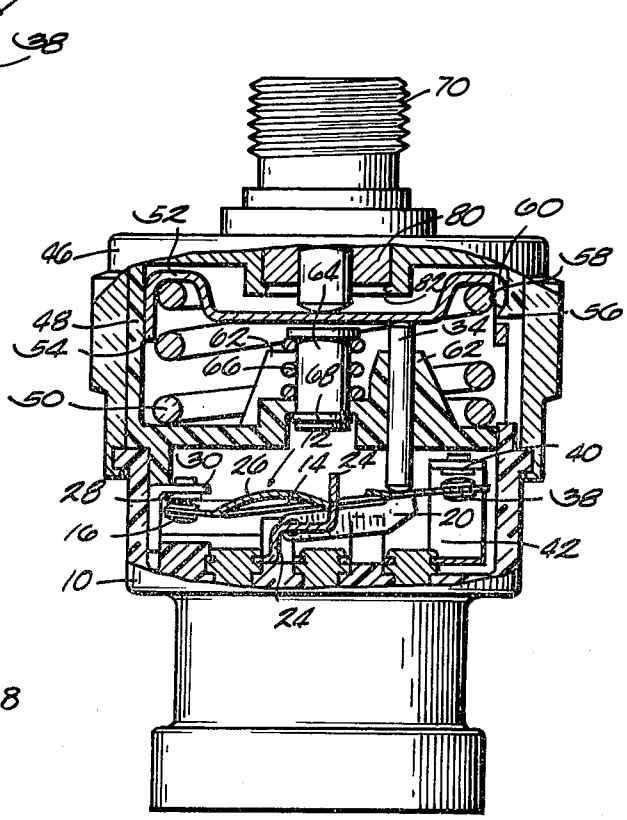
FIG. 3 is a partial view similar to FIG. 1, but shows the parts in the position where the slow-moving contact has opened the circuit controlled by that contact.
Figure 2A:
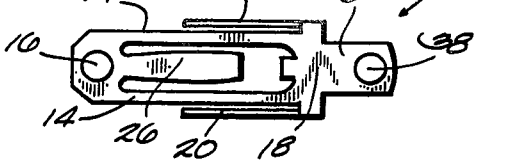
FIG. 2A is a plan view of the switch blade and FIG. 2B is a side view of the switch blade.
Figure 2B:
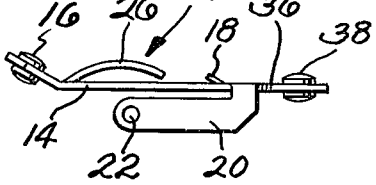

As previously indicated, FIG. 1 shows the pressure switch in the at-rest position. As the pressure builds up on the piston 74, it will move down to first take up the gap between the upper end of the follower 34 and the underside of the locator 52. Then a little further downward movement will move contact 38 away from contact 40 to open the lamp indicator circuit, as shown in FIG. 3. This now will indicate that the brake system is working and there is at least minimum pressure in the brake system. The relay circuit controlling the hydraulic pump for building up the brake system pressure is still made through contacts 16 and 28. Thus, the pump will continue operating. A further build-up of pressure will now take up the gap between the underside of the spring locator 52 and the top of the plunger 64 and start compressing the spring 66, as shown in FIG. 4 where the plunger 64 has moved downwardly as shown by the gap between the C-ring 68 and the underside of the cup 48.

Figure 4:
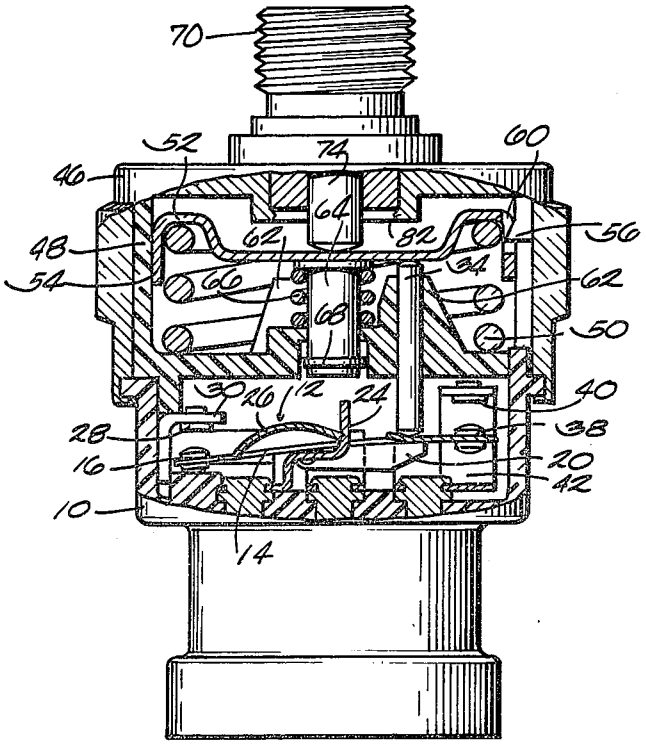
FIG. 4 is similar to FIG. 3 but the slow-moving contact has moved further from its fixed contact and the snap acting contact has moved away from its fixed contact. The actuator is working against both springs.

FIG. 4 also shows that when the snap acting end of the blade 12 has opened as illustrated in FIG. 4, the creep action contact 38 has moved down further from the position shown in FIG. 3. The contact 38 and the blade actuating point 18 can continue to move downwardly as the pressure continues to build up until finally the spring locator 52 will rest on the various bosses 62, preventing further downward movement. The design of the switch blade 12 illustrated here can accommodate the overtravel (which is appreciable) with no problem at all.

Figure 5:
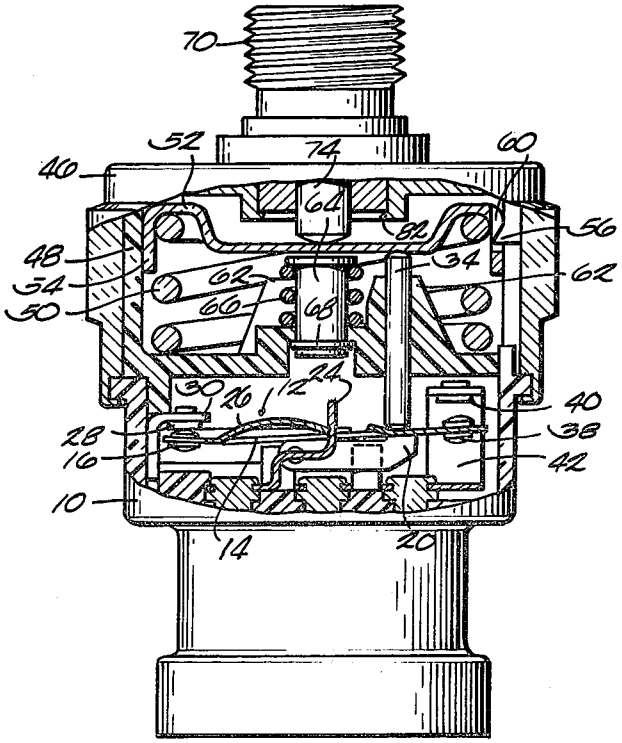
FIG. 5 is similar to FIG. 4, but shows the snap acting contact returned to its normal or at-rest contact while the slow-moving contact is still away from its fixed contact and the small spring has been deactivated.

When the pressure starts falling, either from the position shown in FIG. 4 or from the full downward position as just described, the first thing that will happen is that the central or secondary spring 66 drops out of consideration, as shown in FIG. 5. After that point has been reached, the snap-acting contact 16 will again close on fixed contact 28 to re-establish the circuit to the brake fluid pump to start building up the system pressure again. When the pressure has risen to a high level, the pump circuit again opens as illustrated in FIG. 4. Normal operation of the brake pressure system results in a cycling back and forth between the two positions illustrated in FIGS. 4 and 5. If the brake pump fails for any reason, the pressure will continue to drop until finally the creep or slow-moving contact 38 will engage fixed contact 40 to turn on the indicator light warning the operator of the vehicle that the brake system is no longer safe.

The present switching arrangement guarantees sequencing and is ideally suited to the described system since the indicator light can be satisfactorily operated with a creep or slow-acting switch contact as opposed to many circuits which require snap-acting contacts.

Figure 6:
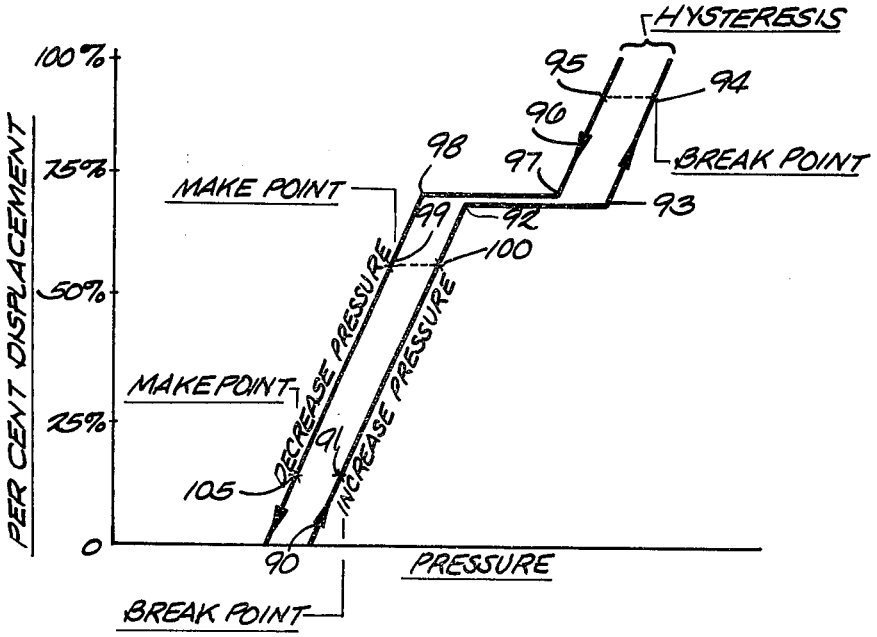
FIG. 6 is a graph showing the operation of the construction shown in the drawings.

The graph in FIG. 6 shows the manner in which pressure and percent displacement of the actuator are related. Going from the at-rest condition shown in FIG. 1, the lamp circuit is "on" and as the pressure builds up along line 90 it reaches the point where the creep action contact opens at 91 to open the circuit through the indicator lamp. The pressure continues to increase and at point 92 the secondary spring 66 is engaged to cause the force to further displace the actuator to increase markedly to point 93 before the secondary spring can be compressed. Now the pressure increases up to point 94 where the pump motor circuit is opened. The pressure will now drop to the pressure indicated at 95 before the actuator starts returning along curve 96. The gap between 94 and 95 represents system hysteresis. At the point 97 the secondary spring 66 goes out of the system and at the point 98 the secondary spring 66 is out and the pressure continues to drop until the condition shown in FIG. 5 is reached at the point 99. At this point, the pump circuit is made again, and the pressure moves directly over to the point 100, whereupon the displacement starts to increase.

Figure 7:
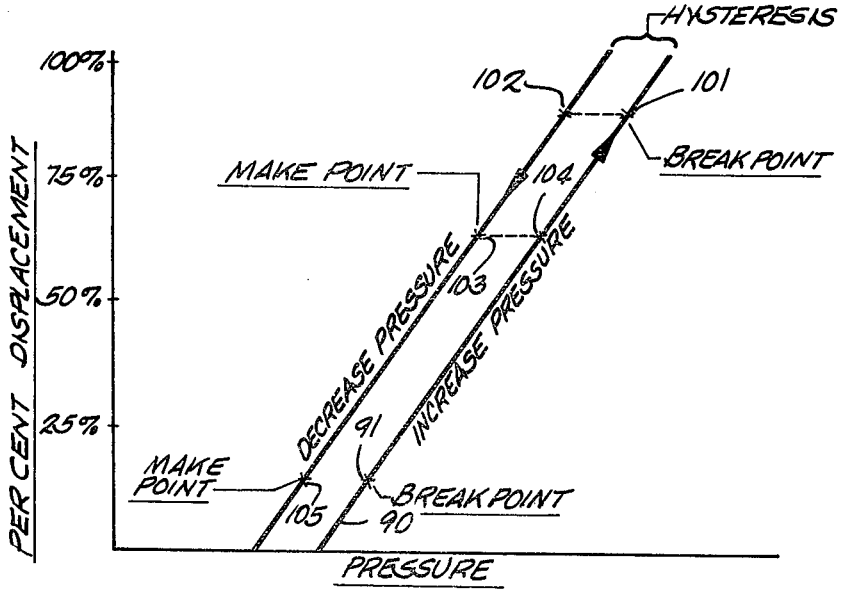
FIG. 7 is similar to FIG. 6 but shows a graph which would be associated with the same construction without the secondary or central spring.

If the secondary spring 66 is omitted, then the curve which is followed would be that shown in FIG. 7. The point 91 is the same as in FIG. 6, but here the curve 90 increases as a straight line function until the break point 101 is reached and the pump circuit opens. Then hysteresis causes the curve to move over to the point 102 whereupon the pressure and percent displacement decrease to the point 103 to make the pump circuit, causing the pressure to move directly over to the point 104 before starting to increase to the point 101. If there is a pressure failure, the pressure would move from the point 103 down to the point 105 to cause the lamp circuit to come on. The same point 105 can be found in FIG. 6.

As previously indicated, it is less expensive, and therefore desirable in some instances, to use the design in which the secondary spring 66 is omitted. This does, however, necessitate provision for adjusting the location of the various fixed contacts and pivots.

We claim:

1. A pressure switch including:

a housing a switch in said housing comprising a blade having an actuated portion, a contact bearing end which moves with a snap action between stops, at least one of which is a contact, when the actuated portion of the blade is moved with gradual motion between two limits, a contact for one of the limits and a contact on the actuated portion of the blade engageable with the limit contact in a slow make, slow break manner;

three electrical terminals in said housing respectively connected to said blade and to said stop which is a contact and to said limit contact;

a spring cartridge including a cup, a spring in the cup, and a spring locator bearing against the spring and slideable in the cup;

an actuator engaged by the spring locator and engaging the actuated portion of the blade; and pressure responsive means bearing on and actuating the locator to compress the spring.

2. A pressure switch according to claim 1 in which said spring locator is engaged by said cup to limit outward movement of the locator whereby the spring is pre-loaded and the cartridge is handled as a unitary sub-assembly.

3. A pressure switch according to claim 2 in which the pressure responsive means includes:

an inlet to the housing;

a piston slideably mounted in said inlet and bearing against said spring locator; and seal means in said inlet sealing against said piston to substantially prevent leakage therealong.

4. A pressure switch according to claim 3 further including:

a rod mounted in said cup for reciprocal movement toward and away from said locator;

a second spring biasing the rod towards the locator; and means limiting movement of the rod towards the locator so the contact on the actuated portion of the blade moves from the limit contact before the locator engages the rod and starts to compress the second spring.

5. A pressure switch according to claim 3 in which the seal means comprises a tetrafluroethylene annulus having a channel-like cross-section bearing against the piston with the channel opening away from the piston, and an O-ring received in the inside of the channel so pressure acting on the O-ring causes it to force the annulus against the piston.

* * * * *